United States Patent [19]

Dymock et al.

[11] Patent Number: 4,502,941

[45] Date of Patent: Mar. 5, 1985

[54] NON-AQUEOUS HYDROGENATION OF SOLID CARBONACEOUS MATERIAL

[75] Inventors: Kenneth R. Dymock; Malcolm C. E. Bell, both of Oakville, Canada

[73] Assignee: Inco Limited, Toronto, Canada

[21] Appl. No.: 575,349

[22] Filed: Jan. 31, 1984

Related U.S. Application Data

[63] Continuation-in-part of Ser. No. 469,539, Feb. 24, 1983, abandoned.

[30] Foreign Application Priority Data

Feb. 24, 1982 [GB] United Kingdom ..... 8205497

[51] Int. Cl.[3] ..... C10G 1/04; C10G 1/08

[52] U.S. Cl. ..... 208/10

[58] Field of Search ..... 208/8 LE, 9, 10

[56] References Cited

U.S. PATENT DOCUMENTS

| | | | |
|---|---|---|---|
| 4,152,248 | 5/1979 | Feder et al. | 208/144 |
| 4,155,832 | 5/1979 | Cox et al. | 208/10 |
| 4,176,040 | 11/1979 | Hazlett | 208/8 LE |
| 4,190,518 | 2/1980 | Giannetti et al. | 208/8 LE |
| 4,325,802 | 4/1982 | Porter et al. | 208/10 |
| 4,451,351 | 5/1984 | Porter et al. | 208/10 |
| 4,455,218 | 6/1984 | Dymock et al. | 208/50 |

OTHER PUBLICATIONS

L. V. Sidgwick—Chemical Elements and Their Compounds, pp. 1368–1371, Oxford University Press, 1950, vol. II.

*Primary Examiner*—Delbert E. Gantz
*Assistant Examiner*—Anthony McFarlane
*Attorney, Agent, or Firm*—Raymond J. Kenny; Edward A. Steen

[57] ABSTRACT

A nonaqueous process of hydrogenating and liquefying solid carbonaceous material which includes heating the material in contact with a catalyst derived from $FE(CO)_9$ in the presence of hydrogen.

5 Claims, No Drawings

NON-AQUEOUS HYDROGENATION OF SOLID CARBONACEOUS MATERIAL

This application is a continuation-in-part of U.S. application having Ser. No. 469,539, filed Feb. 24, 1983 now abandoned.

TECHNICAL FIELD

The present invention relates to the hydrogenation of solid carbonaceous material e.g. coal and substances derived therefrom, and particularly to the liquefaction of such materials in the presence of a catalyst.

BACKGROUND ART

The hydrogenation of coal is generally carried out by pasting it with a heavy oil and heating the resultant paste in a hydrogen containing atmosphere. High temperatures and high hydrogen partial pressure must be used to achieve hydrogenation; the magnitude of the temperature and pressure required depending on the degree of hydrogenation required. The temperature and pressure requirements can, however, be reduced by the use of catalysts and both homogeneous and heterogeneous catalysts are known.

Heterogeneous catalysts may be supported or unsupported, and each type has its advantages and disadvantages. Supported heterogeneous catalysts, e.g. Co—Mo supported on an aluminum base, tend to be poisoned by the impurities, e.g. V and $TiO_2$, present in the carbonaceous material, they are abraded by the solid carbonaceous feed material, they can be blinded by coke formed during hydrogenation and they also require the use of mechanically sophisticated, and therefore expensive, vessels to carry out the reaction. Unsupported heterogeneous catalysts, e.g. $MoO_3$, $Fe_2O_3$ and FeS, are either poor catalysts or they are expensive and therefore have to be recovered to achieve economic operation. Catalyst recovery from the ash and unreacted feed materials has in the past proved to be extremely difficult. Homogeneous catalysts, i.e. catalysts that dissolve in pasting oil, include transition metal carbonyls and hydrocarbonyls (e.g. $Co_2(CO)_8$), Zeigler catalysts (e.g. nickel naphthenate reduced by triethyl aluminum), and Lewis acids e.g. $AlCl_3$, $SnCl_2$, and $SbF_5$.

The Lewis acid catalysts are disadvantageous because they are corrosive. Generally the other homogeneous catalysts are to a greater or lesser degree unstable at hydrogenation temperatures and pressures and they, like unsupported heterogeneous catalysts, must often be recovered to achieve economical operation. On the other hand, unsupported heterogeneous and homogeneous catalysts can be used in simple furnaces, e.g. plug flow reactors, and they are not fouled by impurities or coking.

In order to liquefy solid carbonaceous material it is generally necessary to use temperatures in the 400°-500° C. range since at lower temperatures, liquefaction does not take place and at higher temperatures, excessive coking occurs. Even within the preferred temperature range some coking often occurs. Coking should be avoided because it reduces the yield of liquid hydrocarbon, which is the most valuable liquefaction product. Coke formation should also be avoided when the catalyst is used in more than one hydrogenation, such a cyclical operation will result in a coke build-up. A reduction of coke formation during hydrogenation makes the operation of the equipment much easier.

Furthermore, at these high temperatures, many catalysts, particularly the homogeneous transition metal carbonyl catalysts, decompose. Also many metal carbonyls vapourise at liquefaction temperatures and pressures, thereby reducing their effectiveness as a catalyst.

It would be desirable to provide an effective catalyst that is cheap and that is available in such quantities that there would be no need to recover it from the hydrogenation product and so could be discarded. Cheap catalysts are known e.g. pyrrhotite, which is a non-stoichiometric mineral form of iron sulphide, $Fe_2O_3$, $FeSO_4$ and Luxmasse, which is a red mud containing $Fe_2O_3$, $TiO_2$ and $Al_2O_3$, but such catalysts are not very effective in promoting liquefaction and preventing coking reactions.

U.S. Pat. No. 4,325,802 ('802) teaches an aqueous method of liquefaction of carbonaceous materials using a metal carbonyl and water gas under alkaline (above 7.5 pH) conditions to form a mixture. The mixture is heated to obtain the hydrocarbon liquids.

SUMMARY OF THE INVENTION

According to the present invention there is provided a catalyst that is both cheap and effective. This catalyst is derived from $Fe_2(CO)_9$, which may readily be made by exposing $Fe(CO)_5$ to ultra violet light in glacial acetic acid. Since the material in the catalyst is solely iron and carbon monoxide, neither of which are intrinsically valuable or scarce, $Fe_2(CO)_9$ is truly disposable. Furthermore, $Fe_2(CO)_9$ gives a greater yield of non-coke products, particularly of hydrocarbon oil, than the simple iron minerals that have previously been used as disposable catalysts. We have also found that the catalyst derived from $Fe_2(CO)_9$ is stable at liquefaction temperatures and pressures and, surprisingly, that it is a better catalyst than $Fe(CO)_5$ and $Fe_3(CO)_{12}$.

Thus according to the present invention there is provided a nonaqueous, essentially pH independent process of hydrogenating and liquefying solid carbonaceous material, which process comprises heating the material in contact with a catalyst derived from $Fe_2(CO)_9$ in the presence of hydrogen.

PREFERRED MODE FOR CARRYING OUT THE INVENTION

The preferred reaction conditions are as follows:

| | |
|---|---|
| Temperature: | 400 to 500° C., more preferably 425 to 475° C. |
| Atmosphere: | A mixture of hydrogen and carbon monoxide, preferably Syngas TM, which is a mixture of approximately 2:1 (by volume) of $H_2$ and CO. |
| Pressure: | 500 to 5000 pounds per square inch (3450 to 34,500 $kN/m^2$), more preferably 4,000 to 4,500 psi (27,500 to 31,000 $kN/m^2$) |

Advantageously, after hydrogenation, the solids residue is separated from the liquid products, e.g. by filtration using critical solvent deashing or anti-solvent deashing techniques, and the solids coked and the solids residue then remaining is fed to a generator for producing further hydrogen and carbon monoxide for use in the hydrogenation process.

There will now be described, by way of example only, a process in accordance with the present invention:

100 grams of Cape Breton high volatile bitumous coal having the following composition (in weight percent):

| | |
|---|---|
| C | 71.2 |
| H | 4.88 |
| N | 1.43 |
| O | 7.0 |
| S | 1.5 |
| Ash | 12.9 |
| Asphaltene | 0 |

was charged to a low pressure autoclave, together with 300 g of coal-derived Domtar aromatic oil having the following composition (in weight percent):

| | |
|---|---|
| C | 92.5 |
| H | 5.73 |
| N | 0.93 |
| O | 1.55 |
| S | .56 |
| Ash | 0 |
| Asphaltene | 2.0 |

and a given amount of catalyst. The resulting slurry was pressurized and charged into a high-pressure autoclave, which was then pressurized with about 2,000 pounds per square inch (13,800 kN/m$^2$) of Syngas (a 2:1 $H_2$/CO mixture) at room temperature.

The autoclave was then heated to about 450° C. and, on reaching this temperature, the pressure was increased to 4,000 to 4,500 pounds per square inch (27,500 to 31,000 kN/m$^2$) and held there for one hour. The autoclave was then cooled to 250° C. and most of the gases vented through a cold trap and assayed (the contents of the cold trap is the so-called "naphtha"). The slurry in the high pressure autoclave was then recycled to the low-pressure autoclave, where a further 100 g of coal was added and the above cycle repeated. A third cycle, which was identical to the second cycle was completed, after which 150 to 200 g of the slurry were bled from the system and two more cycles were completed. The slurry was then allowed to cool to 250° C. and discharged while the vapours were collected in a cold trap. The slurry was mixed with several volumes of benzene to form a low-viscosity slurry, which was then filtered through a jacketed Buchner filter. The collected solids were washed, dried and assayed for ash and organic matter. The benzene in the filtrate was flash distilled at reduced pressure and the oil collected and assayed. The results using as catalysts or derivatives thereof $Fe(CO)_5$, $Fe_2(CO)_9$ and pyrrhotite, which is a mineral containing sulphur in slight stoichiometric excess to iron, and also the results using no catalyst are shown in Table I.

It can be seen that $Fe2(CO)_9$ produces less insoluble organic matter than the catalyst derived from Fe(CO)5 and pyrrhotite, which in turn produces less than no catalyst, and also that the catalyst derived from $Fe_2(CO)_9$ produces a greater quantity of oil, which is the most valuable product of liquefaction, than the other catalysts. Furthermore, it provides greater conversion of coal to hydrocarbon products.

The inventors wish to draw a distinction between the instant invention and U.S. Pat. No. '802. The instant invention is essentially water-free and as a consequence pH independent. '802 affirmatively adds water to the reaction and calls for a pH range preferably between about 7.5 to about 10.7. Indeed, "[a] sufficient amount of water must be present in the reaction mixture or slurry to permit the reaction . . . to proceed." Column 5, line 30 et seq. On the other hand, for the instant invention pH is irrelevant.

Under '802's basic and aqueous conditions, iron carbonyls are hydrolyzed to form carbonyl hydride anions and/or carbonyl dehydrides. Accordingly, suitable quantities of alkalines are required to maintain the requisite pH window. See Column 4, lines 22 et seq. These carbonyl anions will act entirely differently than the $Fe_2(CO)_9$ of the instant invention in the hydrogen transfer to the coal. The carbonyl complex forms an anion in water. The carbonyl, in '802 will, as a consequence, end up being transformed into a different ionic species and will no longer be present as iron carbonyl in the system. By utilizing a non-aqueous reaction and eschewing the additional step of introducing a basic additive to the reactor, the $Fe_2(CO)_9$ is stable and will not break down. In other words, it is believed that '802 and the instant invention utilize different catalysts in order to liquefy carbonaceous materials.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

TABLE I

| Catalyst | None | (Derived from) Pyrrhotite | (Derived from) $Fe(CO)_5$ | (Derived from) $Fe_2(CO)_9$ |
|---|---|---|---|---|
| Catalyst level (g/100 g coal) | 0 | 1.8 | 1.8 | 1.8 |
| Pasting Oil (Asphaltene) (wt % asphaltene; feed oil→ product oil) | 2 29.8 | 2 24.4 | 2. 29.8 | 2 36.3 |
| Conversion (a) (%) | 57.3 | 69.0 | 75.3 | 81.1 |
| $H_2$ consumption (g/100 g maf coal) (b) | 6.5 | 5.0 | 5.1 | 5.9 |
| Product Slate (g/100 g maf coal) (b) | | | | |
| 0 in $CO_2$ | 6.8 | 7.9 | 7.2 | 6.5 |
| $NH_3$ | .5 | 0 | .4 | .4 |
| $N_2S$ | .2 | 1.0 | 1.0 | 1.3 |
| $H_2O$ | 0 | 0 | 0 | 0 |
| C | 7.8 | 8.3 | 7.8 | 7.6 |
| $C_2$ | 4.4 | 5.6 | 4.9 | 4.6 |
| $C_3$ | 3.8 | 4.7 | 4.1 | 5.4 |
| i & n $C_4$ | 1.0 | 1.5 | 2.2 | 2.0 |
| Naphtha (c) | 6.7 | 8.4 | 9.3 | 9.2 |
| Oil (d) | 4.1 | 0 | 6.3 | 15.5 |
| Asphaltene*** | 27.1 | 17.8 | 28.4 | 35.3 |
| IOM*** | 42.7 | 31.0 | 24.7 | 18.9 |
| Unaccounted (b) | 1.2 | 19.1* | 8.7* | −.7 |
| maf coal + $H_2$ | 106.5 | 105.0 | 105.0 | 105.9 |
| Ash | 19.6 | 15.6 | 16.5 | 12.6 |

TABLE I-continued

| Catalyst | None | (Derived from) Pyrrhotite | (Derived from) $Fe(CO)_5$ | (Derived from) $Fe_2(CO)_9$ |
|---|---|---|---|---|
| | 126.1 | 120.6 | 121.6 | 118.5 |

(a) amount of coal that does not end up as coke or unreacted coal.
(b) mineral and ash-free coal
(c) $C_5$ - 204° C. b.p
(d) Benzene soluble fraction 204° C.-504° C. b.p.
*high due to Autoclave leaks, losses are in volatile hydrocarbons
**Insoluble Organic Matter (i.e. coke and unreacted coal)
***Benzene soluble, pentane insoluble The embodiments of the invention in which an exclusive property or privilege is claimed are defined as follows:

1. A direct, pH independent, nonaqueous process of hydrogenating and liquefying solid carbonaceous material, the process comprising:

(a) forming a slurry substantially free of water by combining the carbonaceous material, oil and a catalyst derived from $Fe_2(CO)_9$ which is also combined with said slurry;

(b) heating the slurry to about 400°-500° C.;

(c) pressurizing the slurry to about 500-5,000 psi;

(d) performing the process in an atomsphere consisting essentially of hydrogen and carbon monoxide, and (e) separating the resultant liquid from the solid residue.

2. The process according to claim 1 wherein the temperature is about between 425°-475° C.

3. The process according to claim 1 wherein the hydrogen:carbon monoxide ratio is about 2:1.

4. The process according to claim 1 wherein the pressure is about 4,000-4,500 psi.

5. The process according to claim 1 wherein the carbonaceous material is coal.

* * * * *